United States Patent [19]

Boon

[11] Patent Number: 4,472,084

[45] Date of Patent: Sep. 18, 1984

[54] DEVICE FOR ABSORBING IMPACTS DURING LOWERING OR LIFTING RESPECTIVELY OF THE SUPPORT LEGS OF AN ARTIFICIAL ISLAND

[75] Inventor: Bart Boon, Schiedam, Netherlands

[73] Assignee: RSV-Gusto Engineering B.V., Netherlands

[21] Appl. No.: 298,803

[22] Filed: Sep. 2, 1981

[30] Foreign Application Priority Data

Sep. 4, 1980 [NL] Netherlands ..... 8005012

[51] Int. Cl.[3] ..... E02B 17/08; E02D 31/00

[52] U.S. Cl. ..... 405/211; 405/196

[58] Field of Search ..... 405/195, 197, 203–212, 405/224, 196, 198; 267/136, 140; 188/371, 377

[56] References Cited

U.S. PATENT DOCUMENTS

| | | | |
|---|---|---|---|
| 2,857,510 | 10/1958 | Haggerty et al. | 188/377 X |
| 2,895,301 | 7/1959 | Casagrande et al. | 405/208 |
| 3,928,982 | 12/1975 | Lacroix | 405/224 |
| 3,938,343 | 2/1976 | Lamy | 405/195 X |
| 4,160,060 | 7/1979 | Bynum, Jr. | 405/211 |
| 4,195,950 | 4/1980 | Goldman | 405/195 |
| 4,279,545 | 7/1981 | de Werk | 405/211 |

FOREIGN PATENT DOCUMENTS

| | | | |
|---|---|---|---|
| 2802344 | 7/1979 | Fed. Rep. of Germany | 405/195 |
| 1296386 | 11/1972 | United Kingdom | 267/136 |
| 544789 | 3/1977 | U.S.S.R. | 267/136 |

*Primary Examiner*—Cornelius J. Husar
*Assistant Examiner*—Nancy J. Stodola

[57] ABSTRACT

Device for absorbing impacts during lowering or lifting respectively of the support legs (1) of an artificial island comprising a pontoon and legs that are movable and lockable with respect to said pontoon further comprising the fact that the legs (1) at or near their lower end are surrounded by an apron (3) out of flexible material that is fixed to the circumference of each leg and extends beyond the lower end of said leg.

5 Claims, 1 Drawing Figure

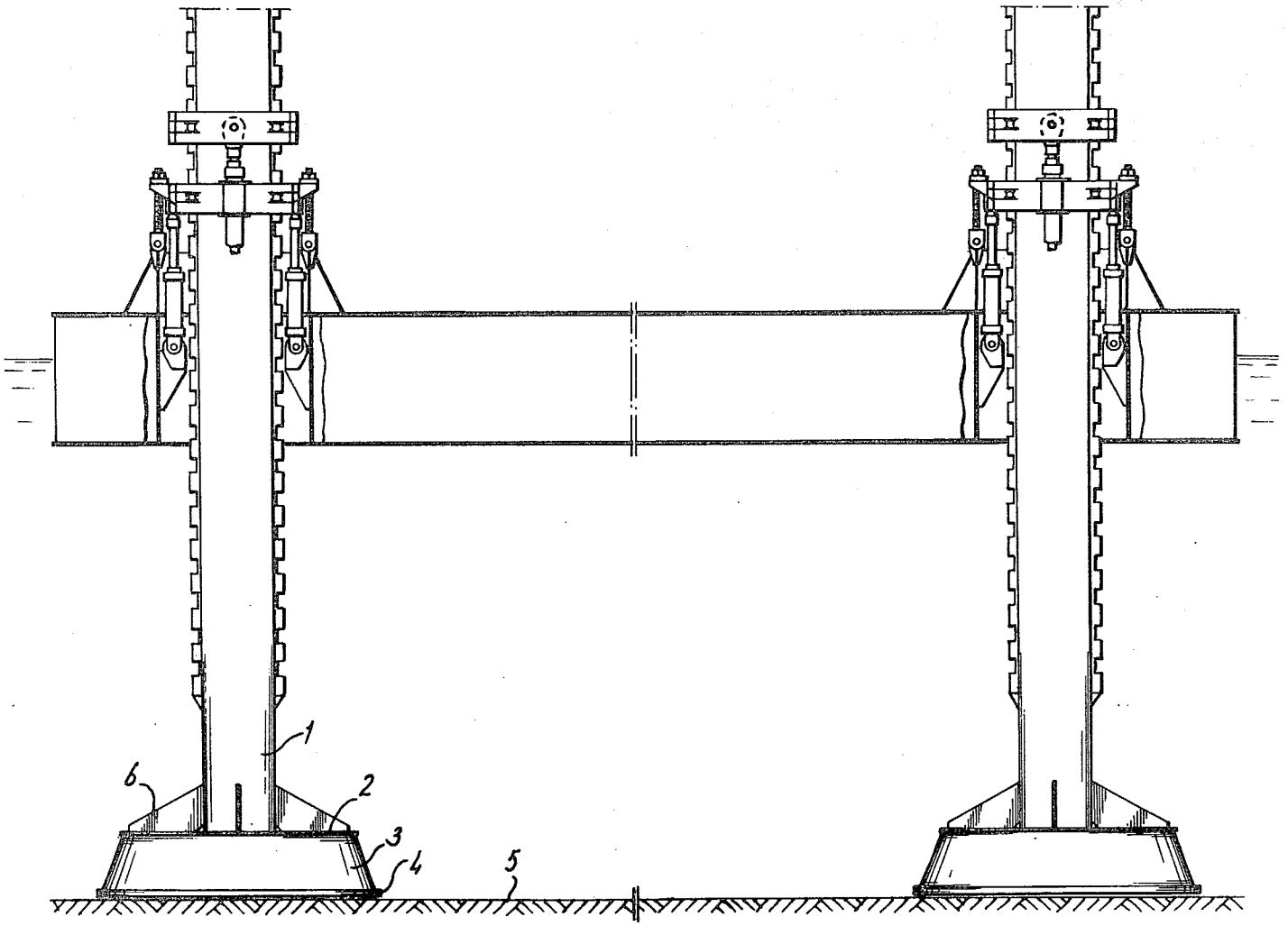
1
2
3
4
5
6

DEVICE FOR ABSORBING IMPACTS DURING LOWERING OR LIFTING RESPECTIVELY OF THE SUPPORT LEGS OF AN ARTIFICIAL ISLAND

The invention is related to a device for absorbing impacts during lowering or lifting respectively of the support legs of an artificial island comprising a pontoon and legs that are movable and lockable with respect to said pontoon.

When lowering or putting down or lifting, respectively, of the legs problems arise as long as these legs are near the ground for due to the fact that the island is moved by the waves the lower ends of the legs will move in a vertical direction and also in a horizontal direction with regard to the ground. This problem whether is not solved or one has tried to remove it by using hydraulic or rubber buffers. This solution is not always effective.

This invention, aims to provide a simple solution and this aim according to the invention is obtained by the fact that the legs at or near their lower ends are surrounded by an apron made out of flexible material that is fixed to the circumference of each leg and extends beyond the lower end of said leg.

The downwardly extending flexible apron defines a water-filled room. As soon as the leg nears the bottom the lower edge of the apron will more or less meet the ground and this means that in case the leg further moves downwardly the amount of fluid enclosed by the apron will be pressed out of said room at its lower side or through said apron or along its connection around said leg respectively. This provides a hydraulic absorption that is effective in both directions. During the movement to the ground the apron is bulged out while during the movement from the ground the apron is sucked against the ground.

In case at the same time a horizontal movement appears this is absorbed also.

The apron can hang downwardly in a cylindrical shape for instance from a horizontal plate connected to the foot be or cone shaped. It can be provided with weights fixed on the lower edge to secure the correct position and these weights may be in the shape of a closed ring or frame that not only stretches the apron but also strengthens it in circumferential direction.

Deviations of the horizontal position of the sea bottom do not provide a problem as the lower edge of the apron adapts itself.

It may be preferred to manufacture the apron out of pervious material for instance sieve material. This promotes a uniform flow of the liquid out of or into, respectively, the room defined by the apron. In case the apron is manufactured out of impervious material than the danger is present that the apron is urged upwardly by the out-flowing liquid.

The invention will now be elucidated with the aid of a drawing.

The single FIGURE of the drawing shows an embodiment given by way of example of a pontoon having supporting legs according to the invention.

The legs 1 at lower ends are provided with a horizontal plate 2 that is connected thereto. On the outer edge of this plate an apron 3 made of flexible material is fixed, of which the lower edge is made heavier with the aid of a circumferentially extending weight 4. The plate can be reinforced by ribs 6. The supporting legs are shown as being movable in the vertical direction with respect to the pontoon and can be locked with respect to the pontoon when the legs are lowered upon the sea bottom 5. The locking arrangement as evident in the drawing is shown in U.S. Pat. 3,411,750 granted Nov. 19, 1968.

In case the leg 1 moves downwardly in the situation as shown the ring 4 of the apron 3 comes to rest on the ground. When moving further the liquid has to escape from the inner side of the apron. This only is possible along the lower edge of the ring 4 or through the apron in case this is manufactured out of pervious material.

The apron may also be manufactured out of impervious material provided with openings.

Moreover the connection of the apron with the leg may be pervious possibly even in one direction.

During lifting also an absorbtion is obtained for in that case an increase of the volume occurs below the leg and in the apron that has to be filled with the onflowing liquid.

The plate 2 provides a widening of the support face of the leg. In case this is not desired the plate can be shaped in such a manner that it may deform easily.

With the invention in a simple way artificial islands can be positioned or moved respectively under more unfavourable weather conditions than until now.

I claim:

1. Artificial island comprising a pontoon and a plurality of supporting legs, said pontoon and supporting legs being movable with respect to each other, locking means provided for locking each supporting leg with respect to the pontoon, each supporting leg having means for absorbing impact during lowering or lifting respectively of the supporting leg with respect to the pontoon, the improvement being that each leg at its lower end is surrounded by an apron (3) made out of flexible material and fixed to the circumference of the supporting leg, said apron extending downwardly beyond the lower end of the leg to form a flexible inverted cup-shaped device whereby said apron comprises said means for absorbing impact.

2. Artificial island according to claim 1 characterized in that said flexible material is pervious.

3. Artificial island according to claim 1 or 2 characterized in that the apron at its lower edge is provided with weights.

4. Artificial island according to claim 3 characterized in that said weights consist of a ring.

5. Artificial according to claim 1 characterized in that the apron is fixed to a horizontal plate that is connected to the leg.

* * * * *